United States Patent [19]

DeMarco

[11] 4,427,257

[45] Jan. 24, 1984

[54] TERMINAL INSULATOR

[76] Inventor: Joseph P. DeMarco, 733 Western Ave., Park Ridge, Ill. 60068

[21] Appl. No.: 310,704

[22] Filed: Oct. 13, 1981

[51] Int. Cl.[3] ..... H01R 13/64

[52] U.S. Cl. ..... 339/184 R; 339/198 J

[58] Field of Search ..... 339/213 R, 213 S, 213 T, 339/263 R, 263 B, 263 E, 198 J, 195 R, 195 A, 195 M, 196 R, 196 A, 196 M, 184 R, 184 M, 184 T, 116 R, 59 M, 272 A, 116 C, 75 P

[56] References Cited

U.S. PATENT DOCUMENTS

| | | | |
|---|---|---|---|
| 2,386,000 | 6/1941 | McQuiston | 339/217 |
| 2,685,074 | 12/1953 | Lazzery | 339/221 |
| 2,760,178 | 8/1956 | Schaefer | 339/116 R |
| 2,930,836 | 3/1960 | Floyd | 339/213 T |
| 2,989,723 | 6/1961 | Hopkins et al. | 339/213 |
| 3,104,925 | 1/1962 | MacNamara | 339/217 |
| 3,113,997 | 12/1963 | Schneiderman | 174/138 |
| 3,188,605 | 6/1965 | Slenker | 339/213 |
| 3,220,807 | 11/1965 | Schmitz | 29/193 |
| 3,221,291 | 11/1965 | Pratt | 339/213 |
| 3,656,083 | 4/1972 | Brook | 339/75 P |

*Primary Examiner*—Eugene F. Desmond
*Assistant Examiner*—David L. Pirlot
*Attorney, Agent, or Firm*—Thomas W. Buckman; Jack R. Halvorsen; John P. O'Brien

[57] ABSTRACT

An insulator is provided for an electrical terminal assembly including a first, relatively fixed terminal member and a second relatively movable terminal member removably connectable with said first terminal member and having at least one wire affixed thereto. This insulator comprises an integrally formed member of insulating material including a tubular sleeve for removably surroundingly engaging the assembly comprising the first terminal member connected with the second terminal member. A first end of the tubular sleeve is substantially open for permitting slidable movement of the tubular sleeve into surrounding engagement with the terminal assembly. A second end of the tubular sleeve includes a passageway for permitting passage therethrough of the second terminal member with the wire affixed thereto. Hence, the wire may be affixed to the second terminal member independently of attachment of the insulator to the terminal assembly.

5 Claims, 7 Drawing Figures

TERMINAL INSULATOR

BACKGROUND OF THE INVENTION

The present invention is directed to an insulator for an electrical terminal, and more particularly to a sleeve-type insulator which is surroundingly engageable with an electrical terminal comprising a first relatively fixed terminal portion removably coupled with a second terminal portion which carries a wire.

Sleeve-type insulators for electrical terminals are well-known in the art. Typical of such sleeve-type insulators are those shown, for example, in McQuiston U.S. Pat. No. 2,386,000. Generally speaking, such sleeve-type insulators comprise a rubber or rubber-like tapered tube member which is slidably engageable with a wire, and thereafter slidably engageable into elastically gripping, surrounding engagement with the junction of the wire with a terminal structure. In using such a prior art insulator or sleeve, however, it is necessary to slidably engage the sleeve over the wire prior to attaching the wire to a terminal. This is satisfactory in some applications.

However, in many other applications a terminal assembly comprises one relatively fixed terminal part and a second terminal part carried on the wire to effect secure coupling of the wire with the relatively fixed terminal part. In such cases, the terminal part carried on the wire is often of larger dimension than the wire itself, for example a space type terminal. Accordingly, the insulator sleeve must be slidably engaged with the wire before attachment of this terminal member to the wire.

Moreover, the tubular sleeve must generally be slidably moved some distance back along the wire to permit interconnection of the wire thereof with the terminal. Typical of such terminal arrangements is a spade-type terminal affixed to one or more wires which is then connected with a fixed bus bar by means of a threaded fastener such as a screw threadably engaged with the bus bar. When using the prior art tapered sleeve insulator, this assembly requires multiple manufacturing operations, resulting in relatively slower and more costly production.

OBJECTS AND SUMMARY OF THE INVENTION

It is a general object of the present invention to provide a novel and improved terminal insulator.

A more specific object is to provide such a terminal insulator which is configured so as to be slidably engageable with a wire carrying a terminal after the connection of the terminal to the wire.

A related object is to provide such a terminal insulator which may be readily removed from an assembled terminal installation without the necessity of physically removing the wire terminal member from the wire.

A related object is to provide such a terminal insulator which is relatively simple and inexpensive in its design and manufacture and yet highly reliable in operation.

Briefly, and in accordance with the foregoing objects, an insulator is provided for an electrical terminal assembly including a first, relatively fixed terminal member and a second relatively movable terminal member removably connectable with said first terminal member and having at least one wire affixed thereto. In accordance with the invention, this insulator comprises an integrally formed member of insulating material including tubular means for removably surroundingly engaging the assembly comprising said first terminal member connected with said second terminal member, a first end of said tubular means being substantially open for permitting slidable movement of said tubular means into said surrounding engagement, and a second end of said tubular means including passageway means for permitting passage therethrough of said second terminal member with said wire affixed thereto, whereby said wire may be affixed to said second terminal member independently of attachment of said insulator to said terminal assembly.

BRIEF DESCRIPTION OF THE DRAWINGS

Other objects, features and advantages of the invention will become more readily apparent upon reading the following detailed description of the illustrated embodiment, together with reference to the drawings, wherein.

DETAILED DESCRIPTION OF THE ILLUSTRATED EMBODIMENT

Figures 1, 2, 3, 4, 5, 6, 7:
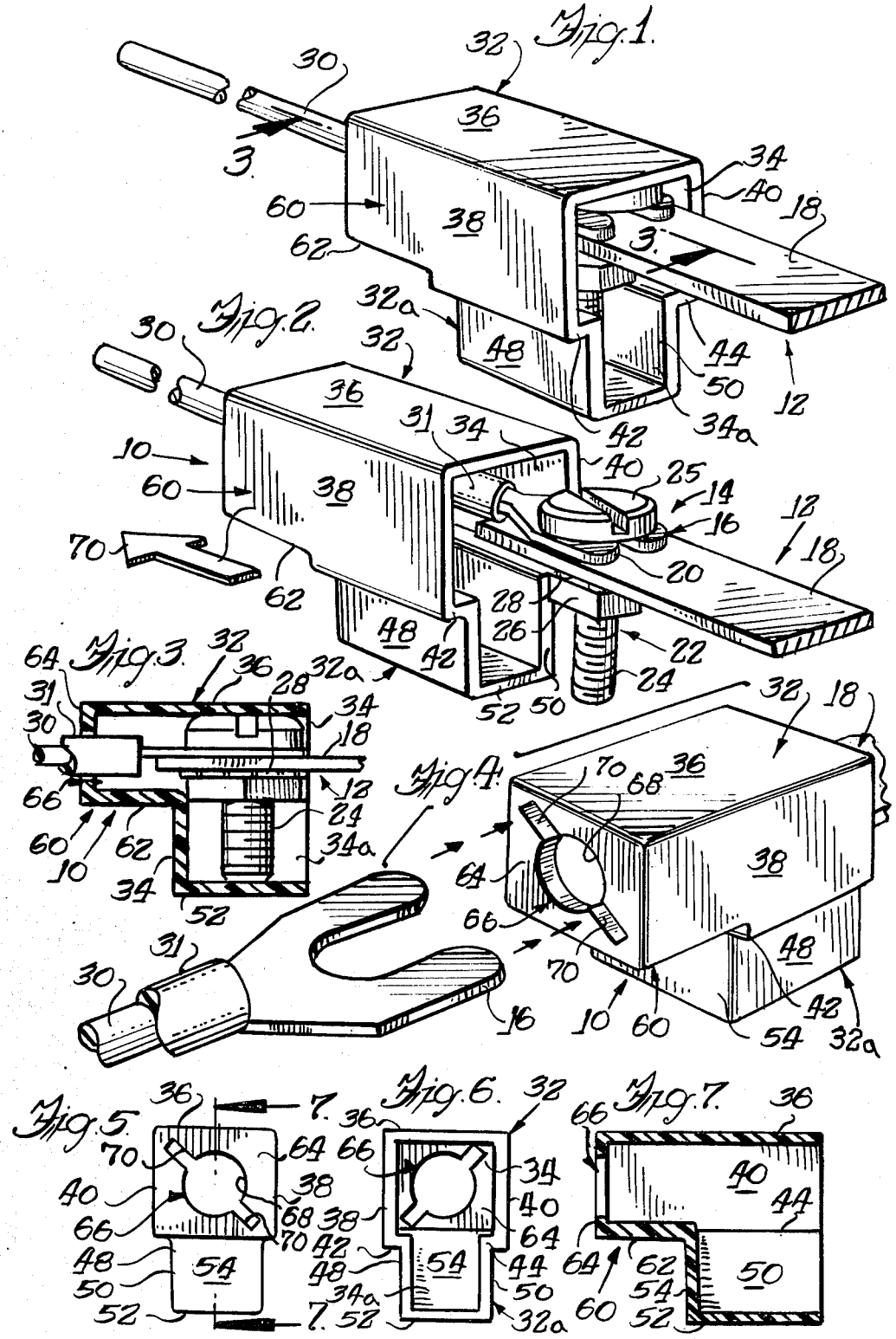
FIG. 1 is a perspective view of a terminal insulator in accordance with the present invention in assembled condition with a bus bar terminal assembly.
FIG. 2 is a perspective view, similar to FIG. 1, illustrating slidable movement of the terminal insulator with respect to the bus bar terminal assembly.
FIG. 3 is a sectional view taken generally along the line 3—3 of FIG. 1.
FIG. 4 is a perspective view taken generally in the opposite direction to the views of FIG. 1 and FIG. 2, and illustrating the assembly of the insulator of the invention with a bus bar terminal assembly.
FIG. 5 is an end view of one end of the terminal insulator of the invention.
FIG. 6 is an end view taken from the end of the terminal insulator opposite the end shown in FIG. 5.
FIG. 7 is a sectional view taken generally along the line 7—7 of FIG. 5.

Referring now to the drawings and initially to FIG. 1 a one-piece molded insulator cover in accordance with the invention is designated generally by the reference numeral 10. In FIG. 1, this insulator or cover is shown in fully assembled condition with an electrical terminal assembly designated by the reference numeral 12. This terminal assembly 12 comprises a first, relatively fixed terminal member designated generally by the reference numeral 14, and a second, relatively movable terminal portion 16.

In the illustrated embodiment, the first terminal portion 14 comprises a relatively flat, elongate bus bar 18 having a through aperture 20 which receives a threaded fastener assembly 22. In the illustrated embodiment, and referring also to FIG. 2 and FIG. 3, this threaded fastener assembly 22 takes the form of a threaded screw 24 having a head 25, a complimentary threaded nut 26 and a lock washer 28, while the second terminal member 16 takes the form of a relatively flat spade or lug-type terminal which is affixed to a wire 30 by suitable means as by crimping or soldering. Additionally, a suitable insulating member, such as a small section of conventional "shrink tubing" 31 is applied over the junction of the terminal 16 with the wire 30. While the insulator or cover 10 is illustrated and described herein in conjunction with the terminal assembly just described, it will be understood that the invention is not limited thereto.

Preferably, the one-piece molded plastic insulator or cover 10 is formed from a suitable plastics material. This insulator 10 comprises a generally tubular member which is formed for grippingly, surroundingly engaging the terminal assembly 12 comprising the first or fixed terminal member 14 and the second, relatively movable terminal 16 connected therewith, as viewed in FIG. 1 and FIG. 3. This surrounding, gripping engagement is enhanced by the relative flexibility both of the plastics material of the insulator 10 and by the tubular form thereof.

In this regard, and referring also to FIG. 5, FIG. 6 and FIG. 7, it will be noted that the tubular insulator 10 includes a first tubular portion 32 which has an open end 34. In the illustrated embodiment, this first tubular portion 32 and the opening 34 are defined by a substantially flat, continuous top wall 36, and a pair of generally parallel continuous side walls 38, 40 which are normal to the opposite sides of the top wall 36.

A pair of inwardly extending shoulder portions 42, 44 extend from the bottom edges of the respective side walls 38 and 40 and are substantially normal to the respective side walls 38, 40 so as to be parallel with and spaced apart from the top wall 36. The above-described walls 36, 38, 40 and shoulders 42 and 44 generally define the first tubular portion 32 and its open end 34 which is configured to slidably, surroundingly and grippingly engage that part of terminal assembly 12 which is located between the head portion 25 of the threaded screw 24, and the nut 26.

A second pair of downwardly depending side walls 48, 50 and a bottom wall 52 define an extension 32*a* of the first tubular portion 32 and an extension 34*a* of the open end 34 thereof. These side walls 48 and 50 and bottom wall 52 are generally formed to loosely surroundingly receive that part of the threaded shank of the screw 24 which extends below the nut 26 when the nut 26 is threadably advanced to engage the terminal parts as just described. This extension 32*a* of the first tubular portion 32 terminates at its end opposite the open end 34*a* in an end wall or abutment surface 54 which abuts a portion of the radially outermost surface of the nut 26 to define the fully assembled or engaged condition of the insulator or cover 10 with the assembled terminal assembly 12, as illustrated in FIG. 3.

An end part of the first tubular portion 32 is designated generally by the reference numeral 60. This end part 60 is defined in part by the walls 36, 38 and 40 of the first tubular portion 32, just described. However, this end part 60 does not engage the terminal assembly 12. Accordingly, a bottom wall 62 of the end part 60 extends outwardly from a point in the end wall 54 somewhat higher than the shoulder portions 38, 40.

In accordance with a further feature of the invention, this end part 60 terminates at an end wall 64 which carries a novel through aperture 66. This through aperture 66 is generally configured to permit the passage of a terminal member such as the spade lug 16, with the wire 30 attached thereto. In this regard, the opening 66 comprises a generally circular central portion 68 having a generally rectilinear slot 70 extending therethrough. This rectilinear slot 70 is of slightly greater dimension than the outer dimensions defined by the terminal 16 to permit passage of the terminal 16 therethrough. Similarly, the central circular opening 68 is of somewhat greater dimension than the insulator 31 surrounding the connected of the terminal 16 and wire 30, to permit passage thereof.

In accordance with a feature of the invention, this through slot 66, and in particular the slot 72 thereof, is offset at a predetermined angle with respect to the angle achieved by the terminal 16 when it is in a fully assembled or connected condition with respect to the terminal member 14, as shown in FIG. 1, FIG. 2 and FIG. 3.

From the foregoing, and as best viewed in FIG. 4, it will be seen that the terminal 16 must be angled, tilted or rotated somewhat to permit passage thereof through the opening 66. Advantageously, then, the insulator or cover 10 of the invention may readily be slipped over a wire 30 after a terminal such as the spade terminal 16 has been coupled to an end thereof. Thereupon, the cover 10 may be slidably moved back along the wire 30, as indicated by the arrow 70 in FIG. 2, to permit coupling of the terminal 16 with a relatively fixed terminal 14, and thereafter slidably engaged over the fully assembled and connected terminal assembly 12 comprising the terminal portion 14 and terminal portion 16.

Moreover, it will be noted that the cover 10 as described above may readily be removed from its engagement with the fully assembled terminal assembly 12. As indicated by the arrow 70 in FIG. 2, this is accomplished by again slidably moving the cover 10 backwardly with respect to the wire 30 to permit disconnection or uncoupling of the portions 14 and 16 of the terminal assembly 12. This also permits removal of the wire 30 with the spade terminal 16 attached thereto through the rear opening or slot 66, for example to be replaced by a different wire 30 and spade terminal 16.

While the invention has been illustrated and described herein with reference to a preferred embodiment, the invention is not limited thereto. Those skilled in the art may devise various alternatives, and changes and modifications upon reading the foregoing description. The invention includes such changes, alternatives and modifications insofar as they fall within the spirit and scope of the appended claims.

The invention is claimed as follows:

1. An insulator for an electrical terminal assembly including a first, relatively fixed terminal member and a second, relatively movable terminal member removably connectable with said first terminal member and having at least one wire affixed thereto, said insulator comprising: a unitary member of insulating material comprising tubular means for removably surroundingly engaging said first terminal member and including one open end and an oppositely facing end part for surrounding at least one wire being of sufficient internal dimension to permit passage of said second terminal member and said at least one wire therethrough, end wall means at a terminal end of said end part and passage means in said end wall means for permitting passage of said second teminal member and said at least one wire therethrough only when said second terminal member is oriented in a predetermined fashion with respect to said passage means, said predetermined orientation being different from the orientation of said second terminal member when connected with said first terminal member and surroundingly engaged by said insulator, and said tubular means further including an extension portion extending from said open end to said end part for accomodating an outwardly extending part of said terminal assembly.

2. An insulator according to claim 1 and further including guide means for guiding said tubular means into surrounding engagement with said terminal assembly.

3. An insulator according to claim 2 wherein said guide means includes shoulder means formed intermediate said extension portion and the remainder of said tubular means for slidably engaging a portion of said terminal assembly.

4. An insulator for an electrical terminal assembly including a first, relatively fixed terminal member and second relatively movable terminal member removably connectable with said first terminal member and having at least one wire affixed thereto, said insulator comprising: an integrally formed member of insulating material including tubular means for removably surroundingly engaging the assembly comprising said first terminal member connected with said second terminal member, a first end of said tubular means being substantially open for permitting slidable movement of said tubular means into said surrounding engagement, and a second end of said tubular means including passage means for permitting passage therethrough of said second terminal member with said wire affixed thereto, whereby said wire may be affixed to said second terminal member independently of attachment of said insulator to said terminal assembly, said tubular means further including an extension portion for accomodating a predetermined portion of said terminal assembly, and guide means for guiding said tubular means into surrounding engagement with said terminal assembly including shoulder means formed intermediate said extension portion and the remainder of said tubular means for slidably engaging a portion of said terminal assembly.

5. An insulator for an electrical terminal assembly including a first terminal member comprising an apertured flat plate and threaded fastener means engageable therewith and a second terminal member comprising a flat plate-like member engageable by said threaded fastener means, and alignable against said flat plate for being urged into mechanical and electrical connection therewith by said threaded fastener means, said insulator comprising: a rectilinear tubular sleeve member surroundingly grippingly engageable with the assembly comprising the connected first terminal member and second terminal member, said tubular sleeve member being open at one end thereof for slidable engagement over said assembly, the opposite end thereof terminating in part in an abutment surface for defining the maximum extent of said slidable interengagement, and a second portion of said opposite end extending beyond said abutment surface for loosely surrounding said wire means and a portion of said second terminal member affixed thereto, said extending portion terminating in an end wall, and a passageway through said end wall comprising a substantially circular portion of greater dimension than said wire and of lesser dimension than at least one dimension of said flat second terminal member and an angularly disposed slot of substantially similar peripheral dimension to said flat second terminal member extending through said circular portion for permitting passage of said second flat terminal member and attached wire through said angularly disposed slot, the angular disposition of said angularly disposed slot being offset from the angular disposition of said flat terminal member when connected with said first terminal member when said tubular sleeve portion is grippingly engaged in surrounding relation therewith.

* * * * *